US007999233B1

(12) United States Patent
Derenzo

(10) Patent No.: US 7,999,233 B1
(45) Date of Patent: Aug. 16, 2011

(54) SYSTEM FOR INSPECTION OF STACKED CARGO CONTAINERS

(75) Inventor: Stephen Derenzo, Pinole, CA (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 663 days.

(21) Appl. No.: 12/176,475

(22) Filed: Jul. 21, 2008

Related U.S. Application Data

(60) Provisional application No. 60/950,918, filed on Jul. 20, 2007.

(51) Int. Cl.
*G01F 23/00* (2006.01)

(52) U.S. Cl. ..... 250/360.1; 250/363.02

(58) Field of Classification Search ..... 250/363.02, 250/360.1

See application file for complete search history.

(56) References Cited

U.S. PATENT DOCUMENTS 5,638,420 A * 6/1997 Armistead ..... 378/57
6,739,468 B1 * 5/2004 Colebrook ..... 220/1.5
7,151,266 B1 * 12/2006 Christo ..... 250/385.1
7,220,967 B1 * 5/2007 Shapiro et al. ..... 250/358.1
7,376,216 B2 * 5/2008 Hodge ..... 378/57
7,677,857 B2 * 3/2010 Takehara et al. ..... 414/140.3
7,932,828 B2 * 4/2011 Britton et al. ..... 340/572.1
2003/0210394 A1 * 11/2003 Wei ..... 356/369
2006/0006338 A1 * 1/2006 D'Emilio et al. ..... 250/358.1
2007/0096037 A1 * 5/2007 Shapiro et al. ..... 250/394
2008/0023631 A1 * 1/2008 Majors et al. ..... 250/336.1
2008/0135772 A1 * 6/2008 Claus et al. ..... 250/390.01

* cited by examiner

*Primary Examiner* — Constantine Hannaher
*Assistant Examiner* — Christine Sung
(74) *Attorney, Agent, or Firm* — Brian J. Lally; Mark C. Lang; John T. Lucas

(57) ABSTRACT

The present invention relates to a system for inspection of stacked cargo containers. One embodiment of the invention generally comprises a plurality of stacked cargo containers arranged in rows or tiers, each container having a top, a bottom a first side, a second side, a front end, and a back end; a plurality of spacers arranged in rows or tiers; one or more mobile inspection devices for inspecting the cargo containers, wherein the one or more inspection devices are removeably disposed within the spacers, the inspection means configured to move through the spacers to detect radiation within the containers. The invented system can also be configured to inspect the cargo containers for a variety of other potentially hazardous materials including but not limited to explosive and chemical threats.

18 Claims, 18 Drawing Sheets

SYSTEM FOR INSPECTION OF STACKED CARGO CONTAINERS

RELATED PATENT APPLICATIONS

The present non-provisional patent application relates to, and claims priority of, U.S. Provisional Patent Application No. 60/950,918 filed on Jul. 20, 2007, which is hereby incorporated by reference in its entirety.

STATEMENT OF GOVERNMENTAL SUPPORT

The invention described and claimed herein was made in part utilizing funds supplied by the U.S. Department of Energy under Contract No. DE-AC02-05CH11231. The Government has certain rights in this invention.

FIELD OF INVENTION

The invention is directed generally to an apparatus, system and methods for inspecting cargo. More specifically one preferred embodiment relates to an apparatus, system and method of inspecting cargo inside stacked containers.

BACKGROUND OF THE INVENTION

In 2006, Congress mandated the Secured Freight Initiative to test the feasibility of inspecting 100 percent of cargo containers coming from overseas for terrorist threats. The Department of Homeland Security (DHS) and the Department of Energy (DOE), in cooperation with maritime industry and foreign government partners, have already launched Phase I of the Secure Freight Initiative (SFI) to deploy a globally integrated network of radiation detection and container imaging equipment to be operated in seaports worldwide. The purpose of the initiative is to prevent terrorists from using nuclear or other radiological materials to attack the global maritime supply chain or using cargo containers to bring the resources for such an attack to the United States. DE-FG02-06ER84516

However, for Secure Freight to succeed, it must balance enhanced container security with an imperative to facilitate efficient global trade. Such a balance in an incredible challenge given that over 20 million shipping containers enter the U.S. each year. Economic considerations require that they be quickly unloaded by crane onto trucks and trains, and only a few percent are inspected.

The risk posed by the smuggling of special nuclear material or a nuclear weapon in cargo containers is obvious. In December 2005, the Department of Homeland Security (DHS) Domestic Nuclear Detection Office (DNDO) issued a Call for Proposals (CFP) that has a section on "long-dwell, in-transit radiation detection in large cargo-container ships." In the introduction, this CFP states "For example, few effective, affordable, near-term technological solutions have been identified for robust detection and verification of shielded special nuclear material at our nation's ports of entry."

The main problem with inspecting stacked cargo containers is inaccessibility; a large fraction of stacked containers cannot be inspected because they are surrounded on all sides by many tons of other containers and cargo. Inspection methods currently used or proposed involve unloading containers from ships and inspecting them individually. Most current research in this area also involves inspecting individual sealed containers using large external equipment. It is not clear whether these methods are fast enough for a sensitive inspection during container loading or unloading or whether they can permit repeated measurements without disrupting the flow of containers. These methods are extremely time-consuming, and thus, expensive, even when only a small sampling of containers is inspected. Furthermore, inspecting a small sampling is not enough to ensure that all cargo is safe. What is needed is an inspection system that can inspect every container when they are stacked, such as during the long times cargo is stacked (i.e. in a port, waiting area or while at sea).

SUMMARY OF INVENTION

The present invention relates to a system for inspection of stacked cargo containers which overcomes many of the problems associated with prior art inspection systems and methods. The instant invention relates to a system and method for inspection stacked cargo containers.

Although the implementation costs associated with this invention may be costly, the loss of a major city in a nuclear explosion could result in the loss of many tens of thousands of lives and more than one trillion dollars in financial losses. Furthermore, the invented system provides an ability to quickly and thoroughly inspect every stacked container, not provided by prior art systems.

One embodiment of the invention generally comprises a plurality of stacked cargo containers arranged in rows and/or tiers, each container having a top, a bottom a first side, a second side, a front end, and a back end; a spacer for creating a defined space between the container rows and/or container tiers; one or more mobile inspection devices for inspecting the cargo containers, wherein the one or more inspection means are removeably disposed within the defined space, the inspection devices configured to move through the defined space to measure radiation. The invented system can be configured to inspect the cargo containers for a variety of potentially hazardous or suspect materials including but not limited to radioactive threats.

The aforementioned needs are satisfied by the one or more embodiments of the present invention which enable the inspection cargo containers whenever they are stacked, either on ships, during transit, or on land.

These and other objects and advantages of the present invention will become more fully apparent from the following description taken in conjunction with the accompanying drawings.

DETAILED DESCRIPTION

The present invention relates to a system for inspecting stacked cargo containers for hazardous materials including but not limited to weapons of mass destruction. Embodiments of the invention describe systems, apparatuses and methods by which stacked containers can be inspected for nuclear materials and other potential hazards (or suspicious materials). Various structural modifications are made for stacking containers so that there are defined spaces along either the tops and/or bottoms and/or along the sides of the containers are described. Once there are spaces between the containers, a mobile inspection apparatus can be deployed within the spaces to inspect each container.

One embodiment of the invention generally comprises:

1. a plurality of stacked cargo containers arranged in rows or tiers, each container having a top, a bottom a first side, a second side, a front end, and a back end;

2. a spacer for creating a defined space between the container rows or tiers;

3. one or more mobile inspection devices for inspecting the cargo containers, wherein the one or more inspection devices are removeably disposed within the defined space, the inspection means configured to move through the defined space.

The invented system can be configured to inspect the cargo containers for radioactive and nuclear threats. The system can also be used to scan for illegal drugs, narcotics, biologics, explosives, chemicals and other suspicious (or illegal) materials or cargo.

Cargo Containers

Figure 1:
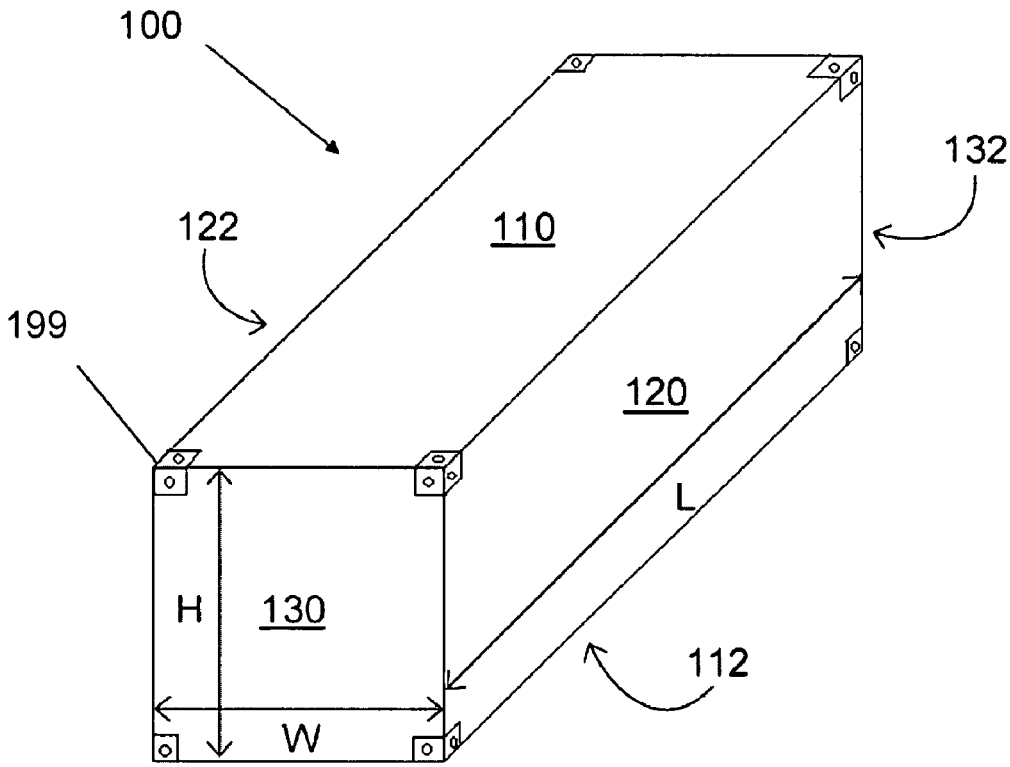
FIG. 1—illustrates a standard shipping container

FIG. 1 shows a schematic diagram of a cargo container 100. The container is a rectangular cube with top 110, bottom 112, a first side (A) 120, a second side (B) 122, front 130, and back 132. Typically cargo containers have ISO compliant castings/fittings 199 at the corners of the containers to allow for lockable connection with trucks, railcars, lifting devices and system, and other transportation means and structures. Container castings 199 are standard on most present day cargo containers, and are designed to interlock with various twist-lock devices (not shown).

The dimensions of cargo containers can vary considerably, however, the majority of cargo containers conform to international standards such as those set by the International Organization for Standardization (ISO). Typically the length L of a container can be as small as about 10 feet and as large as about 40 or 45 feet. The width W is generally about 8 feet. The height H is usually 8.5 or 9.5 feet. There are also half height containers with a height H of 4.25 feet. These are usually used for heavy loads such as steel rods and ingots, which absorb the weight limit in half the normal space. Although the invention is preferably employed on standard containers it may be employed with non-standard containers or future container designs.

The most widely used type of container is the general purpose (dry cargo) container having a nominal length and height of 20'×8.5', 40'×8.5°, and 40'×9.5°. The external and internal dimensions may vary somewhat among containers of the same nominal length and height.

Container Stacks

Figure 2:
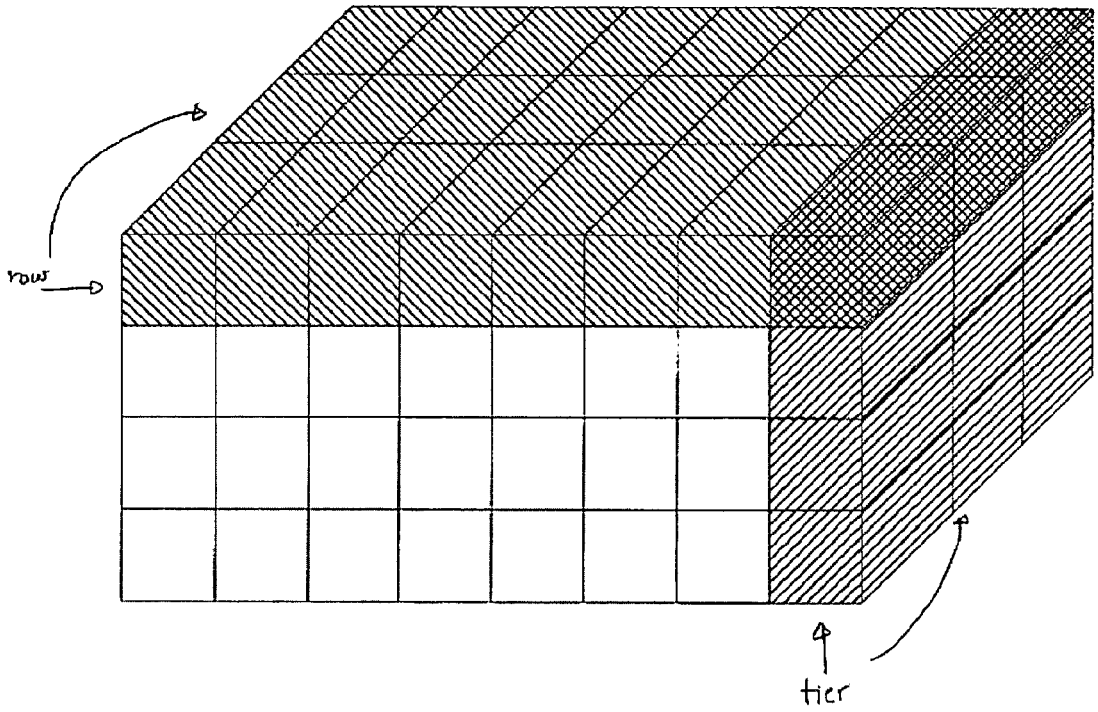
FIG. 2—illustrates stacks of shipping containers arranged in rows and tiers

FIG. 2 is a schematic diagram that shows containers stacked for transport on a ship, a port or other container storage location. As indicated, rows are horizontal layers of containers and tiers are vertical layers of containers. The problem with stacking containers in these arrangements is the inability to get inspection devices between the containers.

In order to be sure that all cargo in a container is probed for nuclear or other hazardous or other suspect material, it is important to get the inspection apparatus as close as possible to the cargo to be inspected. Thus it is more useful to deploy an inspection apparatus along the top 110 and/or bottom 112 of the container 100, FIG. 1. Alternatively, an inspection apparatus can be deployed along the first side (A) 120 and second side (B) 122 of the container 100.

In both these cases, the maximum distance between the center of the container and the inspection apparatus is typically no more than between about 4 feet and 4.75 feet. If the inspection apparatus were deployed along the front 130 and back 132 of the container, the apparatus would be about 20 feet away from the center of a 20-foot container or 20 feet away from the center of a 40-foot container. Thus the invented system allows for dramatically increased inspection ability by allowing the inspection device to get closer to materials within the cargo containers.

Spacer for Creating a Space Between Container Rows/Tiers

A salient aspect of the present inventions is the use of a spacer for creating a defined space or a gap between the containers which allows an inspection device to travel along the tops and/or bottoms of the containers; or alternatively the sides of the containers to allow for more effective container inspection. The container spacer can be employed in a row and/or tier format as described below. The spacer can be a horizontal or vertical spacer, or a vertical spacer shaft as described below.

The spacer can comprise a variety of systems or apparatuses that create a defined space between stacked containers and which allows access by inspection/detection means for inspecting the containers for suspicious materials etc.

The spacer can be configured to create a defined space between the tops and bottoms of containers in a row configured arrangement or the spacer means can create space between the sides of the containers in a tier based system.

Horizontal Spacers

Figure 4:
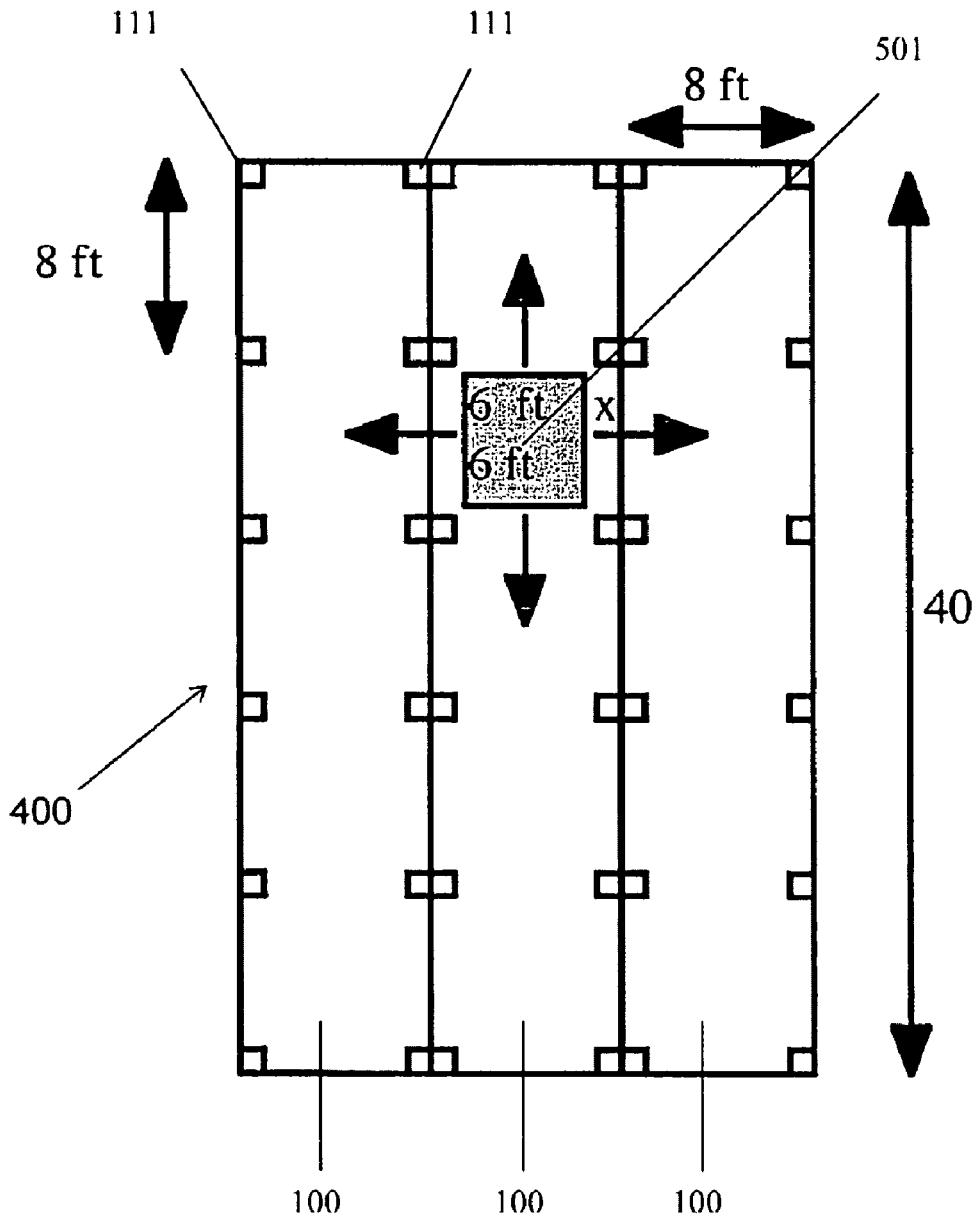
Figure 12:
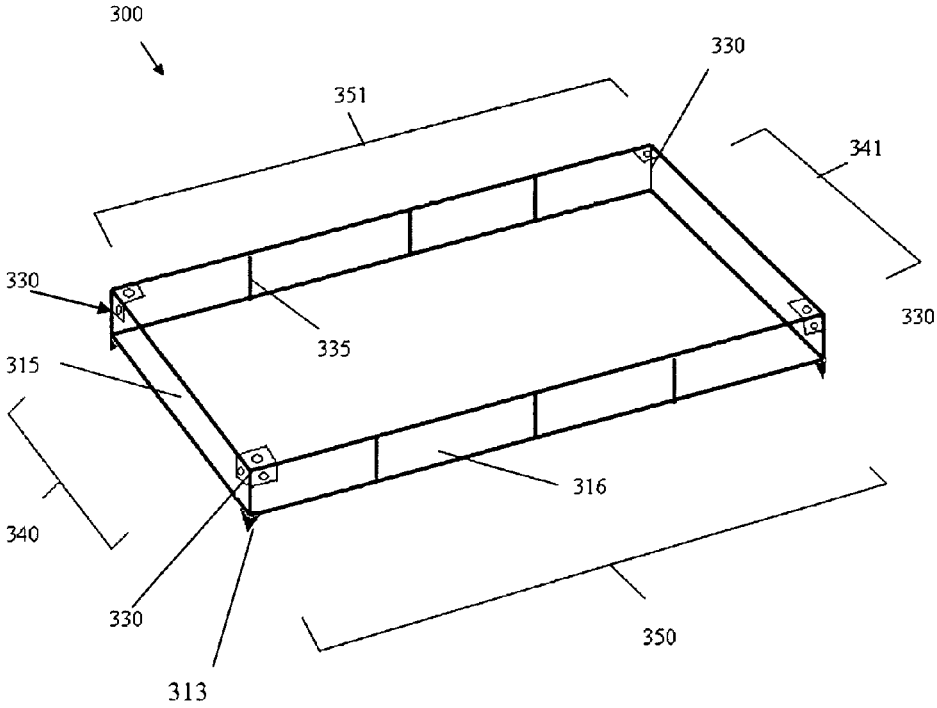
FIG. 12—shows one embodiment of a spacer.

FIG. 12 illustrates one preferred embodiment of a spacer. The illustrated embodiment generally comprises a rectangular frame having a front 340 and a back 341 and a top side 310 and a bottom side 312, a first side 350 and a second side 351, wherein a central aperture 315 runs the length of the frame (i.e. from the front 340 to the back 341 of the spacer. Preferably there are also one or more side apertures 316 running the width of the spacer. Preferably the spacers are generally hollow, with an open frame configuration which allows an inspection device to move through the spacer from front to back and side to side, both within an individual spacer, and between adjoining/adjacent spacers as shown in FIG. 4.

The spacer 300 is designed to attach to the top and/or bottom (or side) of a cargo container. As described the bottom of the spacer has twistlocks 313 that engage complimentary corner castings 199 of a container, see FIG. 3. As noted, the twistlocks 313 and castings 199 preferably lock together, more preferably the twistlocks 313 and castings 311 are ISO and/or ANSI compliant castings and twistlocks. The spacer 300 should provide sufficient space between containers to allow an inspection device to travel between containers and inspect the cargo inside. The spacers should be sufficiently strong to hold the weight of a multitude of full cargo containers.

The top and/or bottom sides of the spacer can have a closed configuration (i.e. with a floor and/or a cover) or the top and/or bottom side may be open (i.e. without a floor and/or cover), FIG. 12. In some embodiments a floor may be beneficial to allow easier movement through the spacer by the inspection means and movement between spacers. Alternatively, in embodiments where no floor is present the inspection device may use the top/bottom of the cargo container below as a support to move.

In the illustrated embodiment the first and second sides 350 and 351 are mainly open, with the exception of optional vertical support rods/columns 335 which provide additional structural support. In some embodiments the sides 350 and 351 are entirely open w/out optional vertical supports.

The top side of the spacer 310 is preferably rectangular in shape and is preferably complementary in shape to the cargo container it attaches to, so that the twistlocks 313 of the spacer align with container's corner castings 199. In the illustrated embodiment the top side is a rectangular metal frame with four corners. The top side 310 has four or more ISO or ANSI castings (ISO 1161:1984) 311. In the illustrated embodiment castings 311 are located at the four corners of top side of the spacer, however, the castings may be place in different locations.

The bottom side of the spacer 312 is also rectangular in shape and is preferably generally the same shape and size of the top side. In the illustrated embodiment the bottom side is a rectangular metal frame with four corners. Four or more twistlocks 313 (preferably also ISO or ANSI compliant) are located on the bottom side of the spacer 312. Preferably the twistocks 313 are located at the four corners of the bottom side, although they may be placed in different locations.

The twistlocks 313 (or other suitable locking means for holding for locking the spacer to a cargo container) allow the spacer to be attached to the castings 199 of standard cargo containers (FIG. 3), while the spacer castings of the spacer 311 allow the cargo container to be picked up by lifts employing twistlocks (if the spacer is attached to the top of the container) or attachment to various transportation means (i.e. trucks, rail cars) or other system/structures employing twistlocks (when spacers are attached to the bottom side of the container), or attached to other cargo containers (i.e. when stacked). Suitable twistlocks and castings are described in U.S. Pat. Nos. 3,749,348; 4,521,044; 4,394,101; 4,125,077; and 6,490,766, all of which are hereby incorporated by reference in there entireties.

The top and bottom of the spacer are connected with at least 4 main vertical corner supports 330 which connect the four corners of the top with the four corners of the bottom of the spacer, FIG. 12. The spacer may also have two or more optional secondary supports 335 connecting the top and bottom.

Figure 13A:
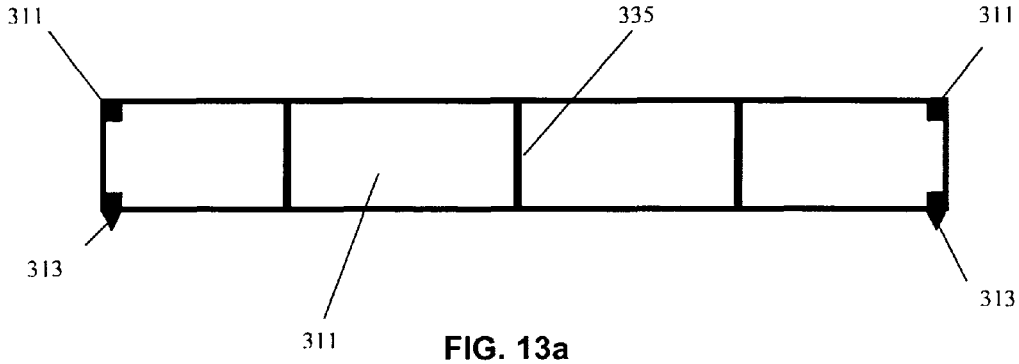
FIG. 13*a*—is a side view of a spacer.

FIG. 13*a* is a side view of one space embodiment. The illustrated embodiment shows two of the main corner support columns 330, as well as several optional side vertical support columns 335 which provide additional structural stability. It is important that there be sufficient space (aperture 316) between the supports so that the inspection means can fit between.

Figure 13B:
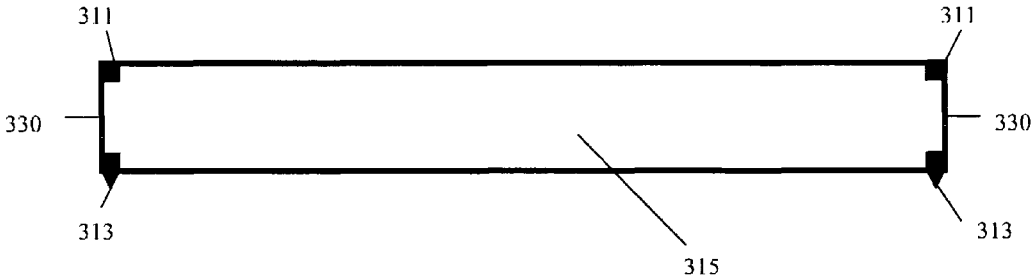
FIG. 13*b*—is an illustration of a front view of the spacer

FIG. 13*b* illustrates a front or back (340 and 341) view of the spacer. The view again shows two of the main vertical corner supports 330. The illustration also shows the castings 311 located at the top corners as well as the twistlocks 313 at the bottom corners.

Figure 14:
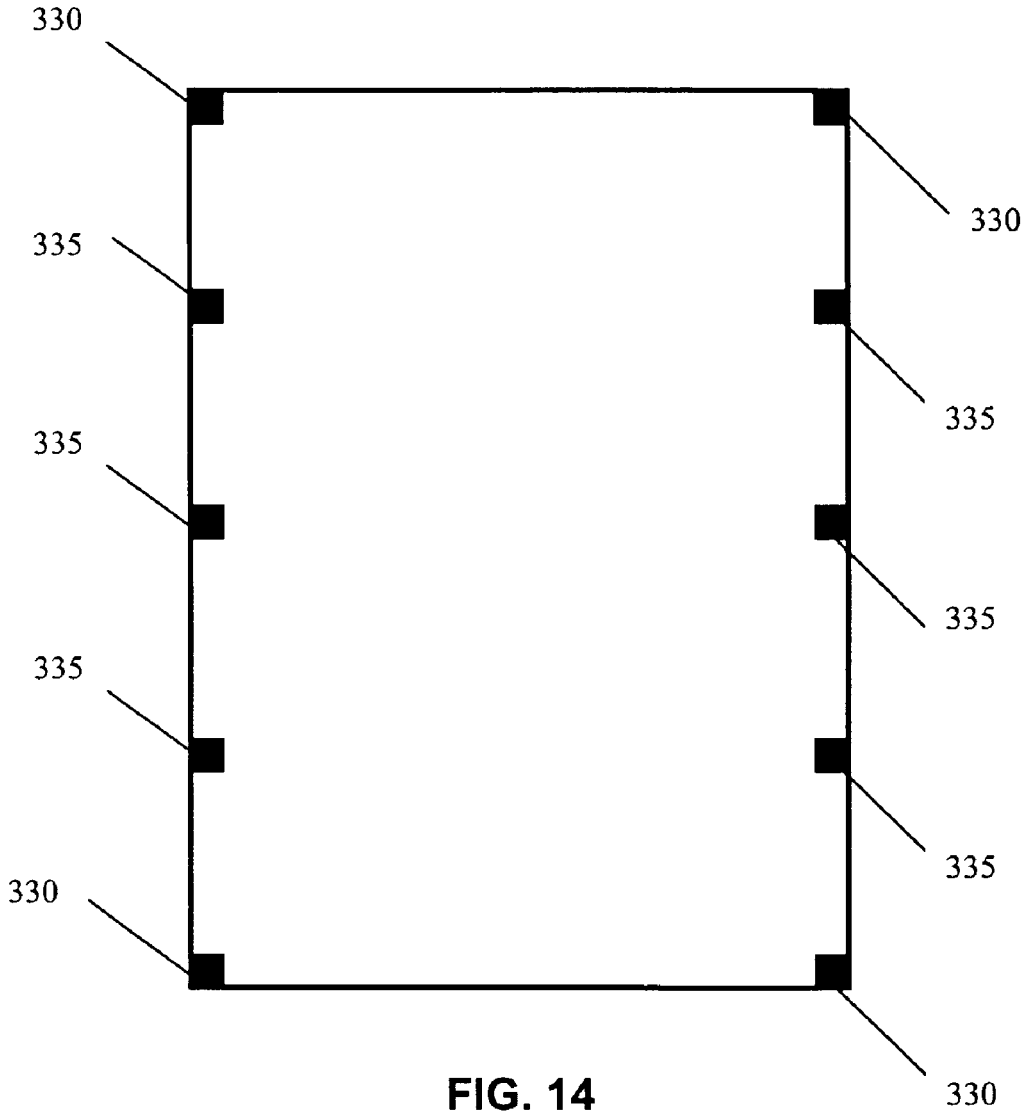
FIG. 14—is a top cut-away view of a spacer showing the vertical support members.

FIG. 14—illustrates a top view of a spacer having four corner supports 330 and a multitude of secondary supports 335, the corners also incorporate corner castings 311. An aperture 315 between the two main supports runs the length of the spacer and a number of apertures 316 between the secondary supports run the width of the spacer. This configuration allows an inspection device to move through the spacer from front to back and side to side, both within an individual spacer, and between adjoining/adjacent spacers as shown in FIG. 4.

As noted above, the described apertures should be of sufficient size to allow relatively free movement of the inspection device within and through the spacer and from spacer to spacer when containers are stacked next to each other and/or on top of each other. Alternatively, the spacers can be incorporated into the top and/or bottom of a new container design.

Vertical Spacers

Figure 6:
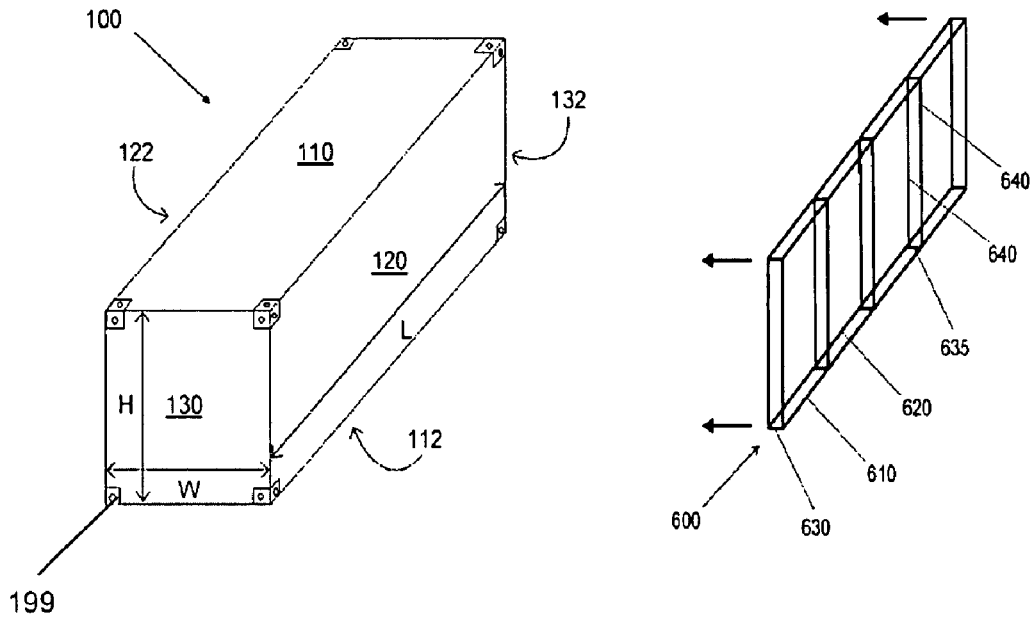
FIG. 6—shows another embodiment of the invention wherein a spacer is attached to the side of a shipping container.

Horizontal spacers described in detail above may be modified or customized to fit and attach to side of a cargo container acting as a vertical spacer 600 as shown in FIG. 6. The spacer twistlocks 313 engage the corners casting 199 and lock into place. The vertical spacers 600 allow space for an inspection device to move freely between cargo containers in a tier configuration.

Vertical Spacer Shaft

Figure 9:
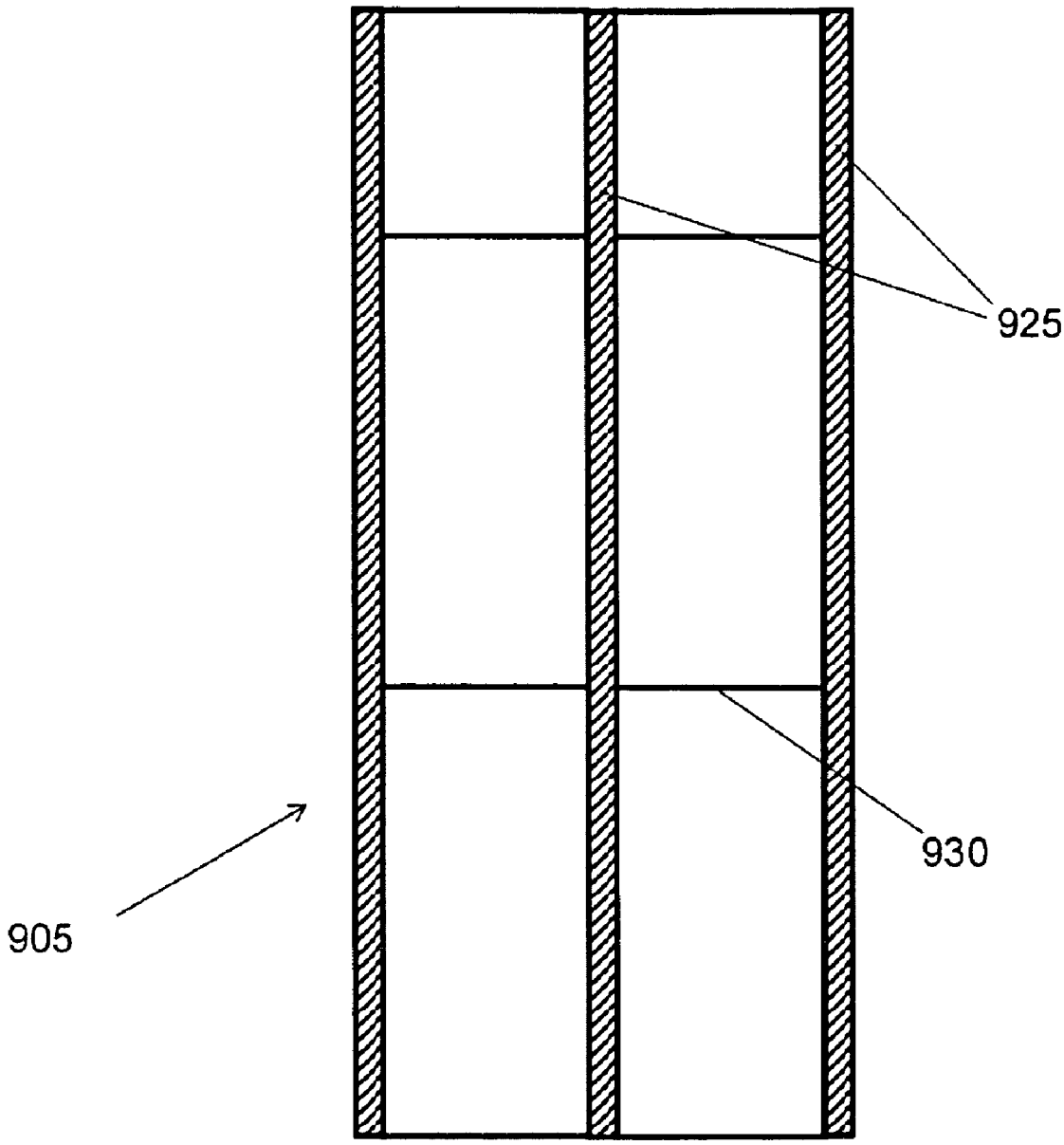
FIG. 9—is a schematic drawing showing a modified cell guide structure according to one embodiment of the invention wherein vertical spacers are added between tiers.

In the alternative, a vertical spacer shaft 925 can be employed between container tiers as shown in FIG. 9. The shaft 925 can be temporary or permanent structure (i.e. at a port, on a ship etc.) As described below, preferably the shaft 925 incorporates a transport means such as a lifting apparatus like a small cargo lift, dumbwaiter, hoist, gantry, cartesian robot, or similar device to transport the radiation detector between different tier levels.

In FIG. 9, the vertical shafts 925 are spaced out to so as to allow separation of stacked tiers of cargo containers (not shown). The illustrated embodiment also includes optional horizontal support bars 930 which help stabilized the vertical shafts 925. The illustrated vertical shafts 925 can be applied as a new structure or can be incorporated into an existing cell structure like the on-ship cell guide structure shown in FIG. 8.

The transport and one or more detectors can be combined to form a vertical, mobile inspection device 500 as described in detail below.

Figure 8:
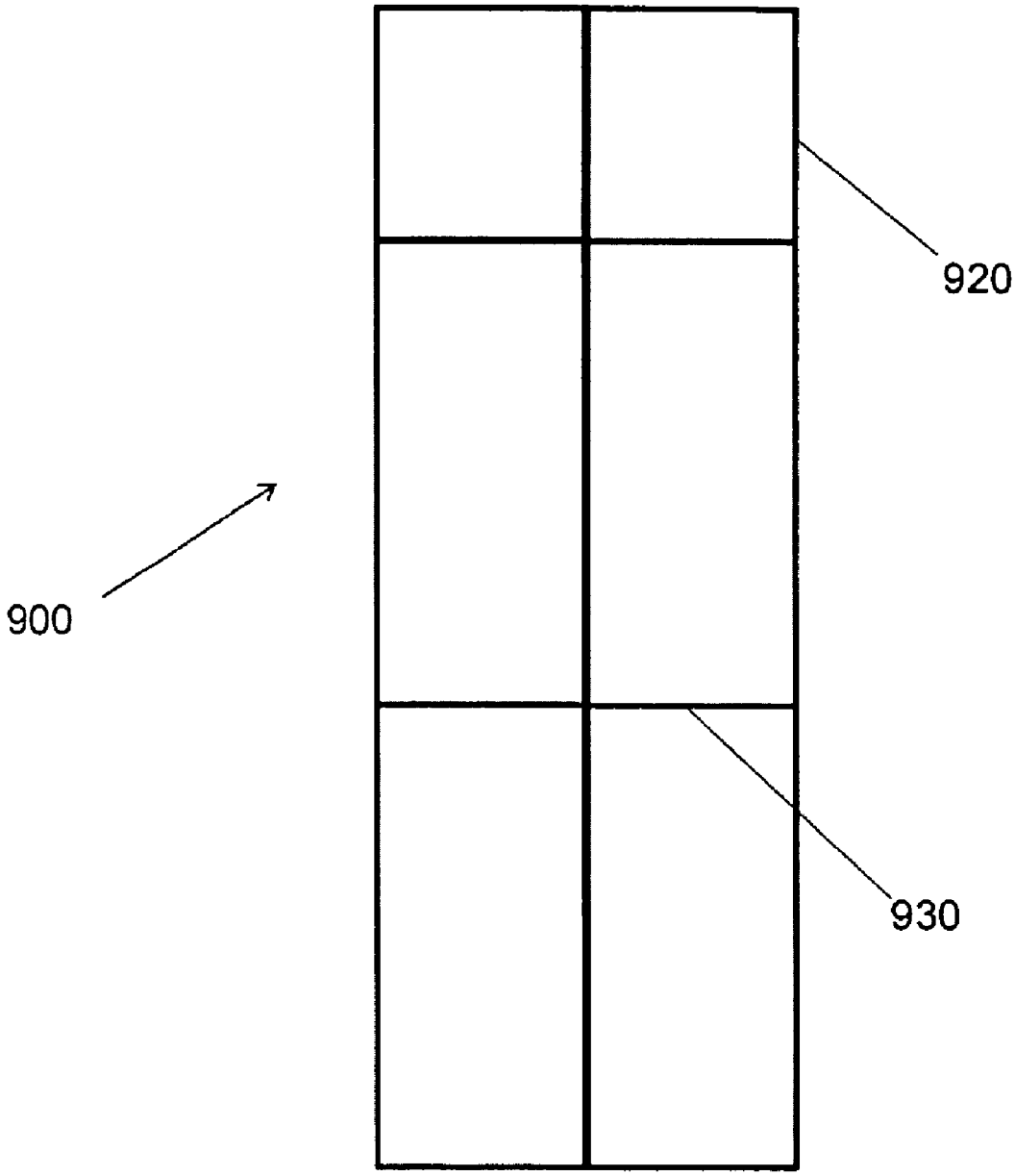
FIG. 8—is a schematic drawing showing a cell guide structure in the hold of ship where containers are loaded into place within the cell guides.

FIG. 8 is an illustration of a typical on-ship or at port cell guide structure for cargo containers having various vertical supports 925 and optional horizontal supports 930.

Mobile Inspection Device

The mobile inspection device generally comprises at least one radiation detector and/or identifier and a transport device or vehicle. The radiation detector/identifier is attached to, and/or housed within, the transport device as described below. In one alternate embodiment, various other inspection devices for detecting contraband, explosive, narcotics etc. can be incorporated into the mobile inspection device.

Radiation Detector/Identifier

Any device/means for inspecting sealed cargo by active or passive detection of nuclear materials and/or other suspect cargo can be used. A wide variety of inspection techniques are possible, such as radiographic, active, and/or passive inspections.

Passive radiation detection systems include but are not limited to: detection of spontaneous fission gammas and neutrons; muon radiography using wire chambers in inspection apparatus above below; gamma spectroscopy. Active detection systems include but are not limited to: transmission radiography using one inspection apparatus with an emission source and another with an imaging detector positioned simultaneously on opposite sides of a container; delayed energetic gammas from fission products after neutron or gamma Irradiation; thermal neutrons to produce fissions neutrons; resonance fluorescence; associated particle imaging using a tagged neutron generator and gamma-ray detectors.

A number of detection devices and methods can be employed including but not limited to those described in U.S. Pat. Nos. 7,327,270; 6,998,617; 7,151,447; and U.S. patent application Ser. Nos. 11/113,694; 10/818,848; 11/160,729; 11/135,801; all of which are hereby incorporated by reference in their entireties.

A number of commercially available radiation detectors and identifiers can be employed including but not limited to various models manufactured by Polimaster (Arlington, Va.) PM1402M, PM1710A, PM 1710GN, PM1801-2, PM2010M as well as PM1401K (chemical and radiation detector). Most Polimaster detectors have built in capability to transmit all recorded data via infrared or radio (Bluetooth) channels to a personal computer (PC) or a Pocket PC. Other detectors are manufactured by Securities Intelligence Technologies (New Rochelle, N.Y.) Dirty Bomb Detector and Radiation Detector RDS-1000; and Berkeley Nucleonics Corp (San Rafael, Calif.) Model 1703MO and Model 1703MO which are equipped with several optional data transmitters to allow fixed-point or wireless communications to a live monitoring network.

In addition to radiation detection, the inspection means may also optionally employ other inspection means including but not limited to the group consisting of: explosive detectors, narcotics, biological agent detectors and combinations thereof. Smiths Detection, Inc. (Arlington, Va.) sells a number chemical, explosive, and narcotic detection (see Smiths Sabre 4000) and x-ray inspection devices (HI-Scan models). See, also and PM1401T (contraband detector) from Polimaster.

Inspection Transport

The inspection/detection apparatus is transported through the spacers by a inspection transport apparatus. The transport can be any type of apparatus, vehicle, or system capable of moving the detector through the spacers. In some embodiments remotely controlled vehicle may be preferred while in others like on-ship system it may be preferable to employ small lifts (i.e. elevator, dumbwaiter, hoist, pulley) or other systems.

Remote Control Device(s)

A computer, pocket pc, remote control or other similar control system can control the motion of the inspection, transport and/or detector means, as well as receive and transmit data/information to and from the identified devices. The control system can be connected to the devices via wireless link (or wired connection if preferred). As described many commercially available transports can be remotely controlled and come with remote control devices. Similarly, many available detectors also have wireless capability to transmit and receive data/control to a computer, pocket pc or other device.

Figure 15:
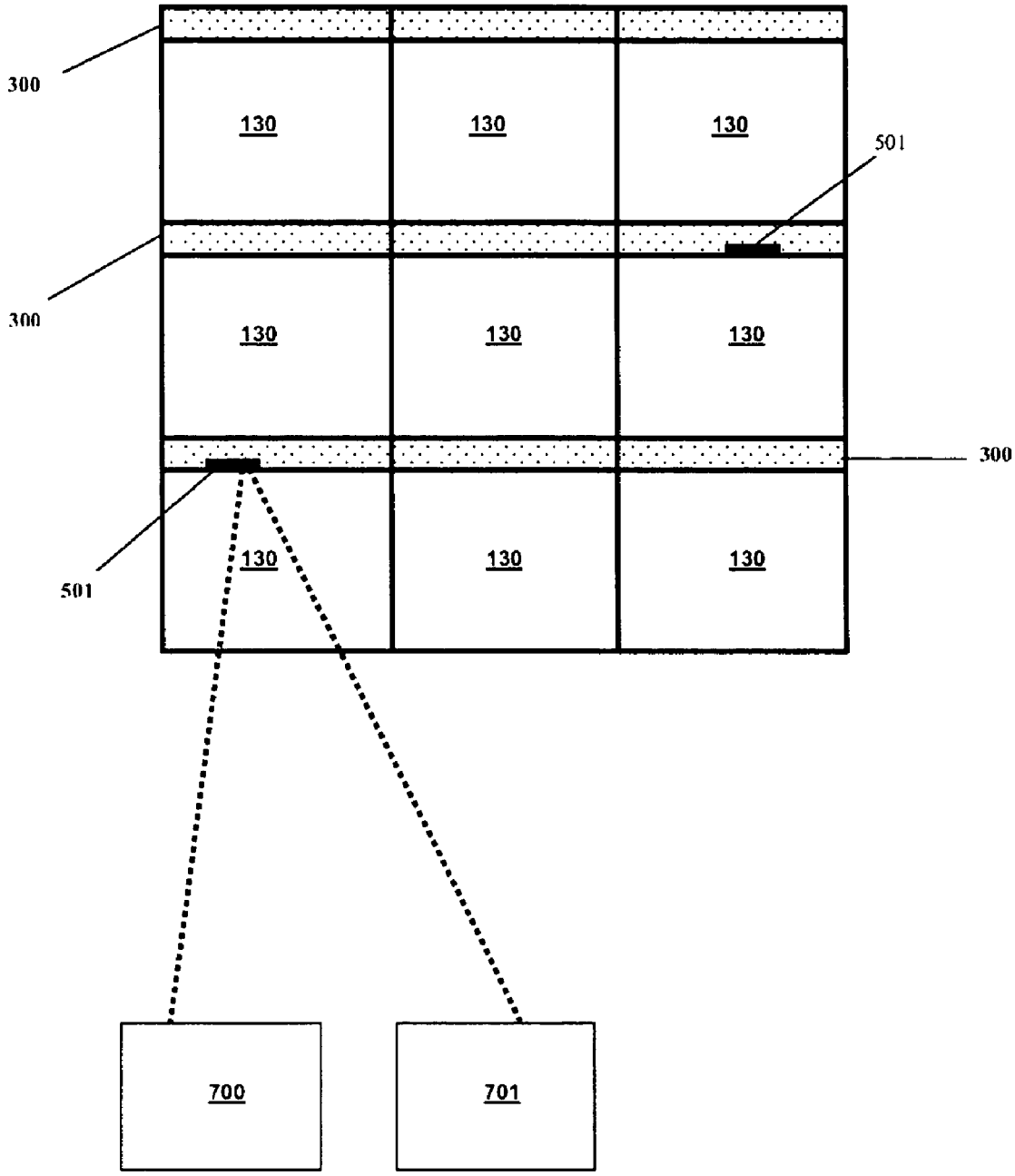
FIG. 15—is schematic of one preferred embodiment of the invention.
Figure 16:
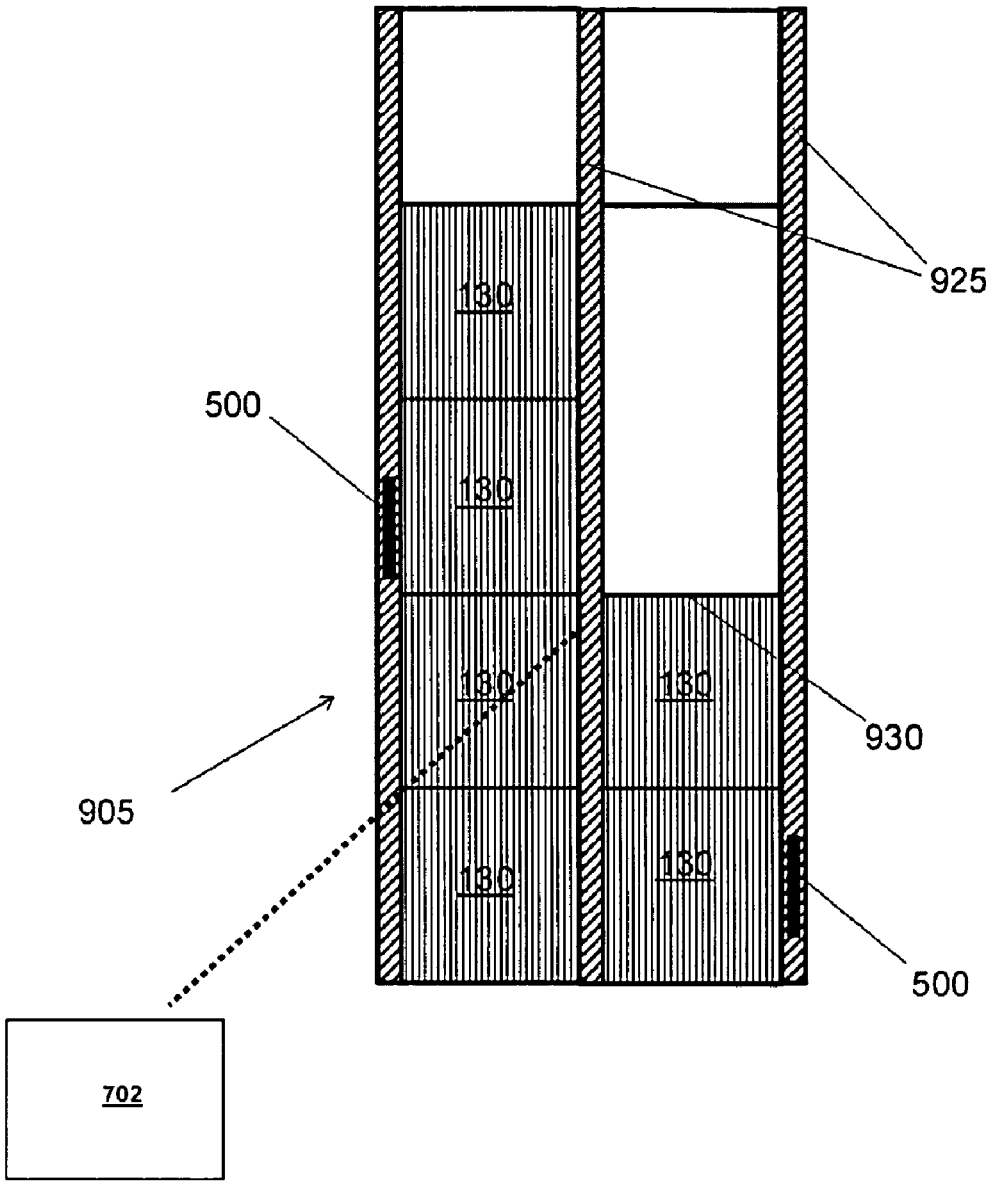
FIG. 16—is schematic illustration of another preferred embodiment of the invention.

As shown in FIG. 15 the remote control device controlling the transport 700 and the device controlling and/or receiving data from the detector(s) 701 can be separate devices, or as shown in FIG. 16 the detector(s) and transport can be controlled by a central control system 702 such as a computer, pocket pc or similar device.

The combined size of the inspection transport and inspection device must be a small enough to travel through the spacers.

In a horizontal system various remotely controlled transport systems may be employed to move the inspection system within and between spacers. One suitable vehicle is the iRobot Packbot manufactured by iRobot (Burlington, Mass.). The iRobot is easily configurable, and the detection means (devices) can be easily mounted onto the iRobot system using standard fasteners and attachments sold by iRobot. It should be noted that the iRobot can move in multiple directions. Other fasteners including but not limited to clamps, tie downs, and other attachment devices can also be utilized. The detector(s) may also be placed into the cargo holds of the iRobot if they are of suitable size. Another suitable transport system is the Talon robot manufactured by Foster-Miller (Boston, Mass.). Detection devices can be attached or incorporated into the Talon in similar ways as attached to the iRobot.

Vertical Transport

In a vertical and/or on-ship system as described below the transport can be a myriad of devices or systems capable of transporting the detector vertically within and between spacers (or vertical shaft) including but not limited to: elevator systems such as traction elevators and hydraulic elevators, other lift systems, hoists etc. Suitable vertical transports include small lift systems such as dumbwaiters which are relatively small in size. One preferred system is a traction commercial dumbwaiter system manufactured by Matot (Bellwood, Ill.).

Other potentially useful systems include a winding drum system by Matot, the vertical valet systems manufactured by the Ultimate Die Corporation (Tampa, Fla.), and a commercial dumbwaiter manufactured by the Inclinator Company of America (Harrisburg, Pa.).

Alternative vertical transports include but are not limited to hoists, small cranes systems, gantry robots, cartesian robots, or spider like crawlers. Exemplary alternative systems include monorail crane/hoist systems manufactured by Stahl Crane Systems USA (Charleston, S.C.) to which the detector can be attached to the hoist hook and raise/lowered as needed, and gantry robot systems manufactured by Gudel AG (Switzerland) to which detectors can be attached. See also U.S. Pat. No. 5,934,141 which is hereby incorporated by reference in its entirety. Such vertical transports can be installed within or incorporated into the vertical spacer shaft. These alternate transports allow both vertical and horizontal movement to enable enhanced detection capability.

Figure 10:
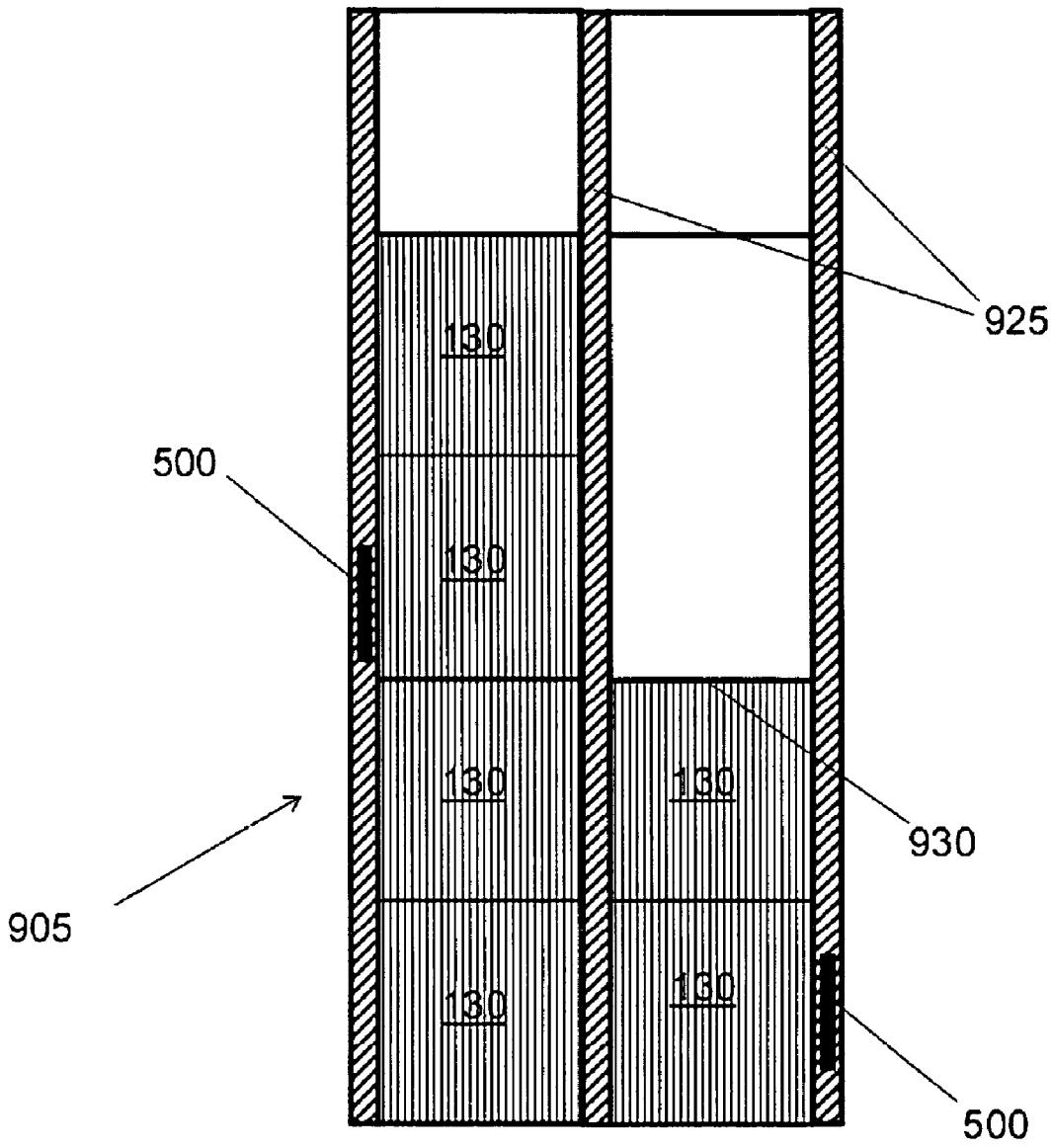
FIG. 10—shows a modified cell guide structure wherein an inspection apparatus moves within the vertical spacers to inspect cargo in the containers.
Figure 11:
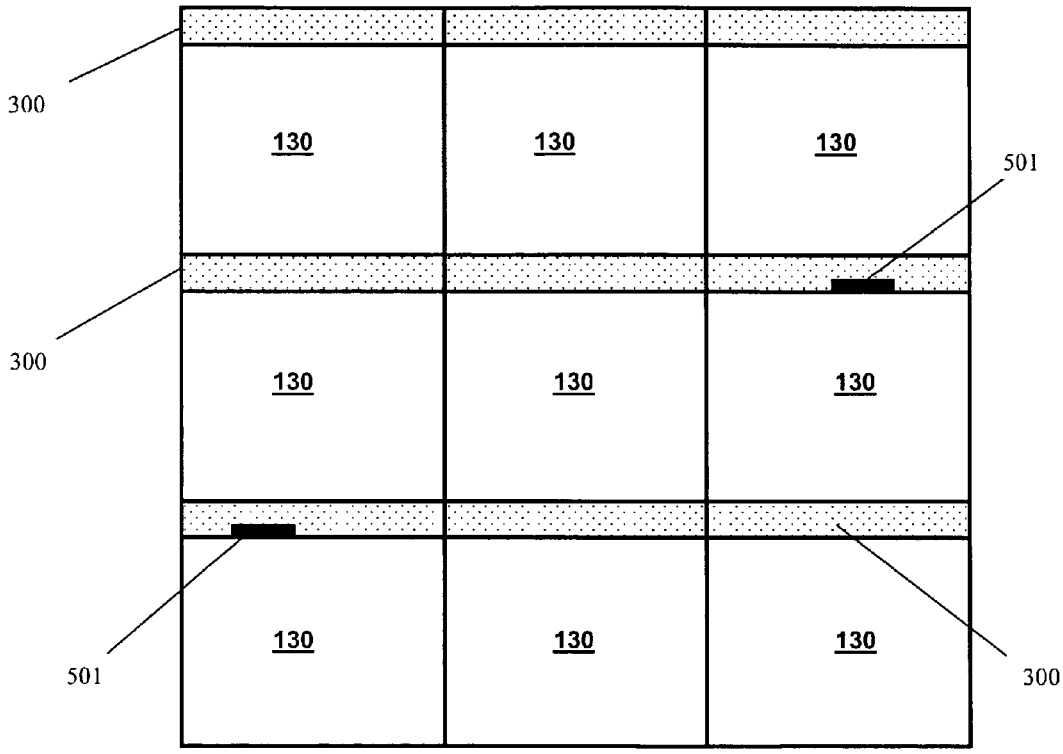
FIG. 11—is a schematic illustration of a row arranged system wherein rows of spacers separate rows of containers, wherein inspection means move within the spacers to inspect the cargo.

FIG. 10 shows one illustrated embodiment of the system employing a series of vertical shafts 925, wherein vertical transports 500 are placed between and/or incorporated within the vertical shafts 925. The vertical transports 500 transport a radiation detector (and/or other detectors) along the height of the tier of stacked cargo containers for inspection.

Row Configured System

In one embodiment of the invention a row configured system is employed and the inspection apparatus is deployed along the top 110 and/or the bottom 112 of the container 100.

The system generally comprises a plurality of stacked cargo containers arranged in container rows, each container having a top, a bottom, a first side, a second side, a front end, and a back end; a multitude of container spacers for creating a defined space between the container rows, wherein the container spacers are attached to the top or bottom of the stacked cargo containers forming a series of spacer rows; one or more mobile inspection device for inspecting the cargo containers, wherein the one or more mobile inspection device is removeably disposed within one or more of the defined spaces created by the multitude of spacers, wherein the mobile inspection devices comprise: at least one radiation detecting detector or identifier attached to or incorporated into a mobile transport device, wherein, the mobile inspection device is capable of moving within the space created by the spacer to detect radiation within the cargo containers.

Figure 3:
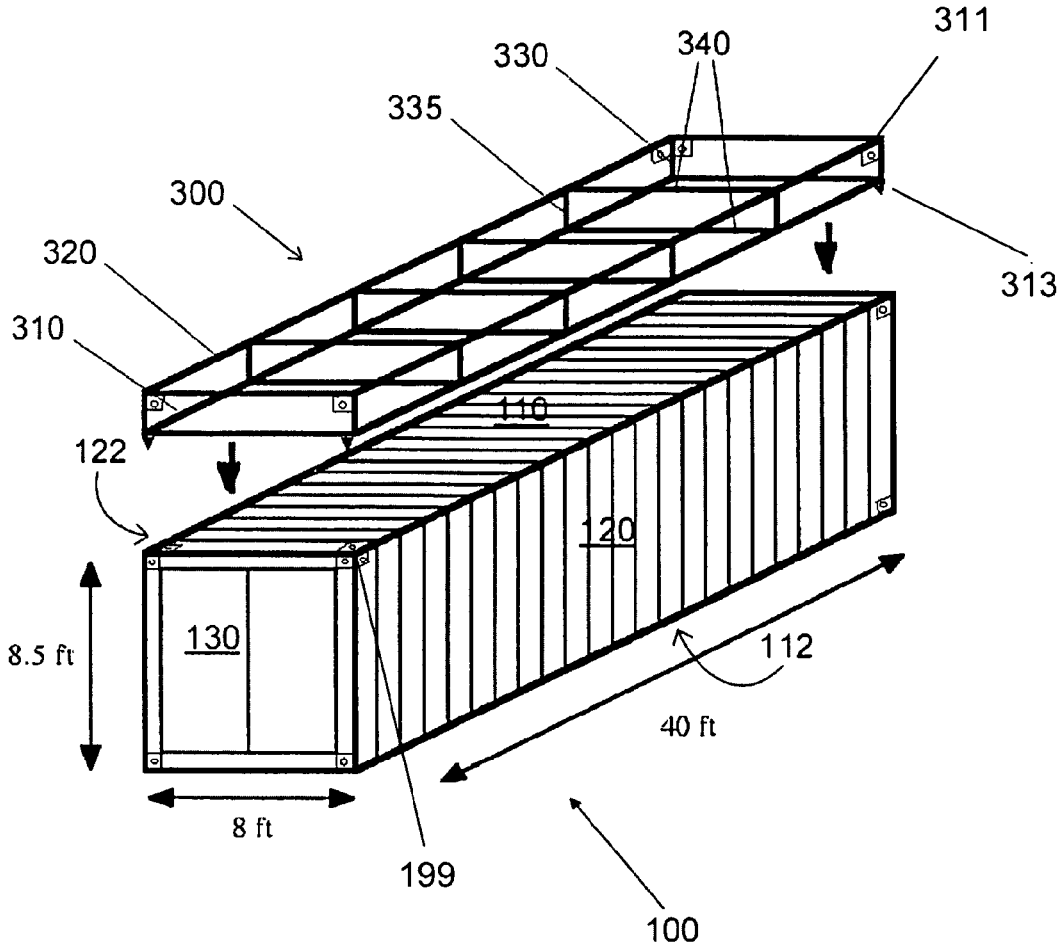
FIG. 3—shows one embodiment of the invention wherein a spacer is attached to the top of shipping container FIG. 4—is a top cross-sectional view of three shipping containers arranged in a row wherein each container has a novel spacer attached its top (more)

FIG. 3 shows a schematic diagram of a container 100 modified for a row configured arrangement. A horizontal spacer 300 is positioned at the top 110 of the container 100. It should be noted that the horizontal spacer could alternatively be positioned below the container.

The horizontal spacer 300 can be permanently or removeably attached to the container 100. The spacer can be made of materials such as steel, aluminum or any other material appropriate for containers. The twistlocks 313 engage the complimentary castings 199 to engage and lock the spacer and container together.

The horizontal spacer 300 show in FIG. 3 has a rectangular bottom portion 310 that can be attached to the top 110 of the container 100. The bottom portion 310 has approximately the same width W and length L as the container 100. The horizontal spacer 300 has a rectangular top portion 320 that is approximately the same size as the bottom portion 310.

In the illustrated embodiment (FIG. 3) there are four vertical corner posts 330 that join the bottom portion 310 to the top portion 320. In some arrangements there are fittings at one or both ends of the corner posts 330, which can be used either for attaching the horizontal spacer 300 to the container 100, for attaching a crane to the spacer/container assembly for lifting the assembly, or both.

In one arrangement, the corner posts 330 have a height of approximately 2 feet. In another arrangement, the corner posts have a height; one suitable height is between about 6 inches and 3 feet, preferably less than 3 feet. The height of the corner posts can be determined by the space necessary for the inspection apparatus to move easily through the horizontal spacer 300.

As described above fittings/castings are preferably attached or incorporated into some the corner posts; however, the fitting may also be placed along different locations along the spacer as needed or desired. A myriad of fittings can be employed however fittings preferably abide by ISO standards and should be compatible with the various castings employed on standard cargo containers. See, U.S. Pat. Nos. 6,998,617; 5,570,981; 6,974,164; which is incorporated by reference in its entirety. Suitable twistlocks include those manufactured by Sea Box (East Riverton, N.J.); Krisry International, also sells corner castings, (Wauconda, Ill.) can also be employed on the corner posts as described.

The horizontal spacer 300 is preferably sufficiently strong to support a tier of at least 5 containers, more preferably at least 10 to 20 loaded containers. In one illustrated arrangement (FIG. 3) there are several optional vertical supports 335 at intervals between the bottom portion 310 and the top portion 320. Many combinations of spacing intervals and strength of optional vertical supports 335 are possible to make the horizontal spacer 300 strong enough to support about 10 to 20 loaded containers.

Optional horizontal members 340 can be used to add stability to the horizontal spacer 300 and/or to provide tracks along which the inspection apparatus can move (see FIG. 3).

With a horizontal spacer 300 attached to the top or bottom of the container 100, the container can be loaded and unloaded from ships, trains and trucks in the same way as before the horizontal spacer 300 was attached.

When the containers 100 are closely stacked, the spacers 300 are contiguous or nearly contiguous, such that the inspection apparatus can move through the continuous space provided by the spacers 300 along the tops 110 of all the containers in a row. An additional layer of spacers 300 can be positioned below the entire stack to allow the inspection apparatus access to the bottom portion of the bottom row of containers.

In one embodiment the spacers 300 have steel grids on their floor and ceiling so that the inspection apparatus can use gears or another grabbing mechanism to move to and lock at any desired point, even during high seas.

FIG. 4 is a schematic drawing that shows a layer 400 of contiguous spacers 300 as they would appear on the tops of a row of containers (not shown).

Figure 5:
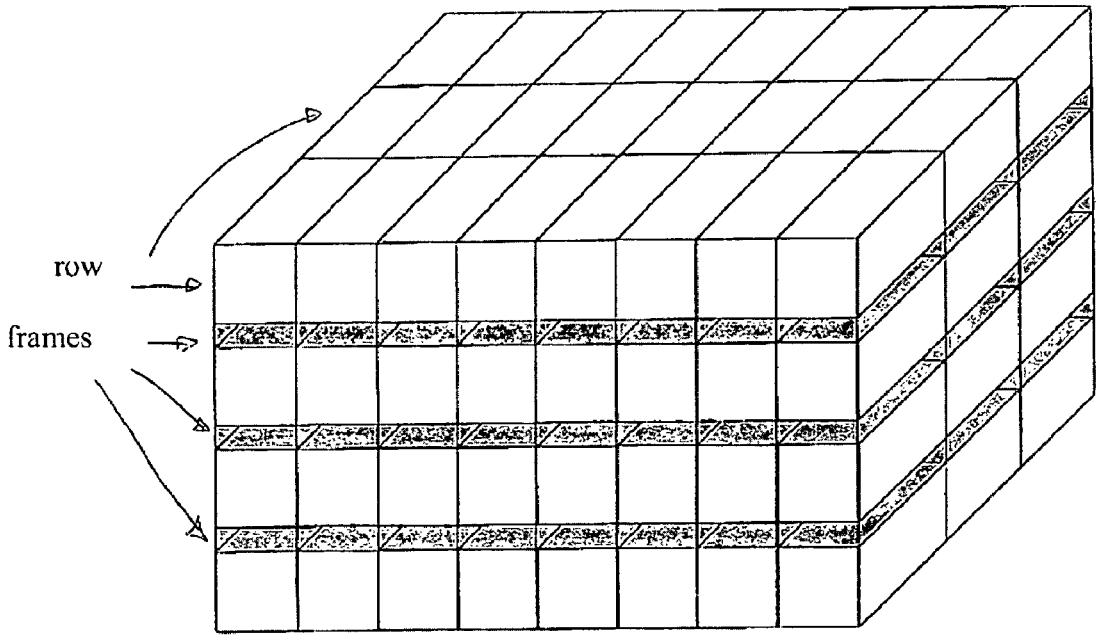
FIG. 5—is a schematic drawing of one embodiment of the invented system wherein the rows of containers are separated by rows of spacers.

FIG. 5 shows a portion of a container stack with spacer rows 400 between container rows 333. In one arrangement, the spacer rows 400 between every row of containers 333 has at least one inspection apparatus (not shown). In other arrangements, crew members can be trained to remove an inspection apparatus from one spacer layer 400 after an inspection is finished and move the inspection apparatus to another spacer layer 400. Thus the number of inspection apparatus for performing a full inspection is reduced.

A horizontal inspection device w/transport as described above is inserted into each row of spacers and the inspection device is maneuvered within each spacer and between spacers to detect and/or identified potential threats. The detection device is preferably wirelessly connected to a PC or pocket PC. See, FIGS. 15 and 16.

Figure 18:
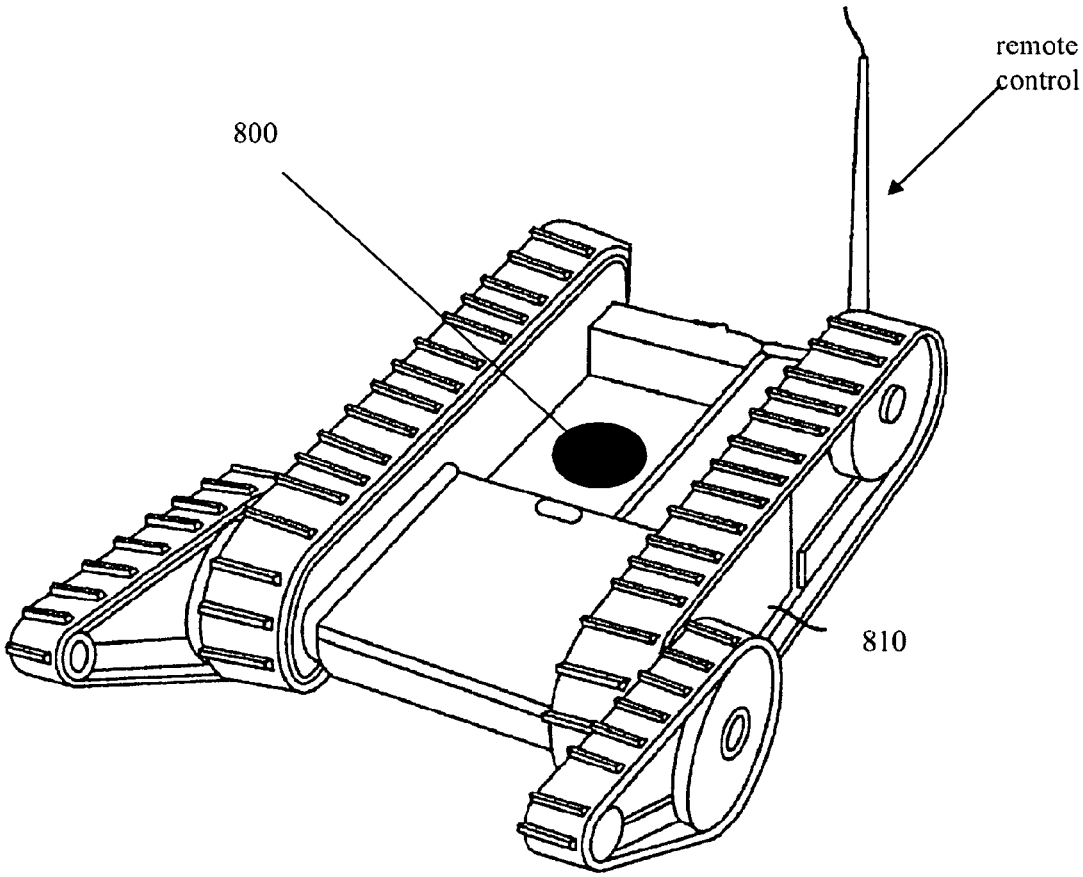
FIG. 18—is an illustration of a transport device which can transport an attached detection device within a horizontal spacer and between adjacent spacers.

FIG. 18 shows one embodiment of the horizontal inspection device generally comprising a mobile transport 810 (i.e. iRobot) with attached detector (i.e. radiation detector) 800, wherein the inspection device is remotely controlled.

Alternate On-Ship or Port Configuration

FIG. 9 is a schematic drawing showing a vertical shaft structure which can be a new structure or a modification to a typical cell guide structure like that of FIG. 8. In this embodiment, vertical spacers 925 are added between tiers of cargo. Inspection devices 500 can move within the vertical spacers 925 to inspect cargo in containers 130, as shown in FIG. 10. In some cases existing cell structures may be retrofitted with the vertical spacers 925, an in other the new cell structures incorporating the vertical spacers may be necessary.

The mobile inspection device 500 can move vertically between containers using a variety of means including but not limited to lift systems, (i.e. elevators), hoists, pulleys or other apparatuses or systems capable of moving up/down through the spacer system as described herein. The mobile inspection device 500 comprises a vertical transport and a detector.

As discussed above, in one preferred embodiment the vertical spacer incorporates a lift a lift system of suitable size to vertically transport the inspection apparatus between containers. In one preferred embodiment such spacer is or incorporates into the spacer a dumbwaiter system capable of vertically transporting the detector from one cargo row to the next.

Figure 17:
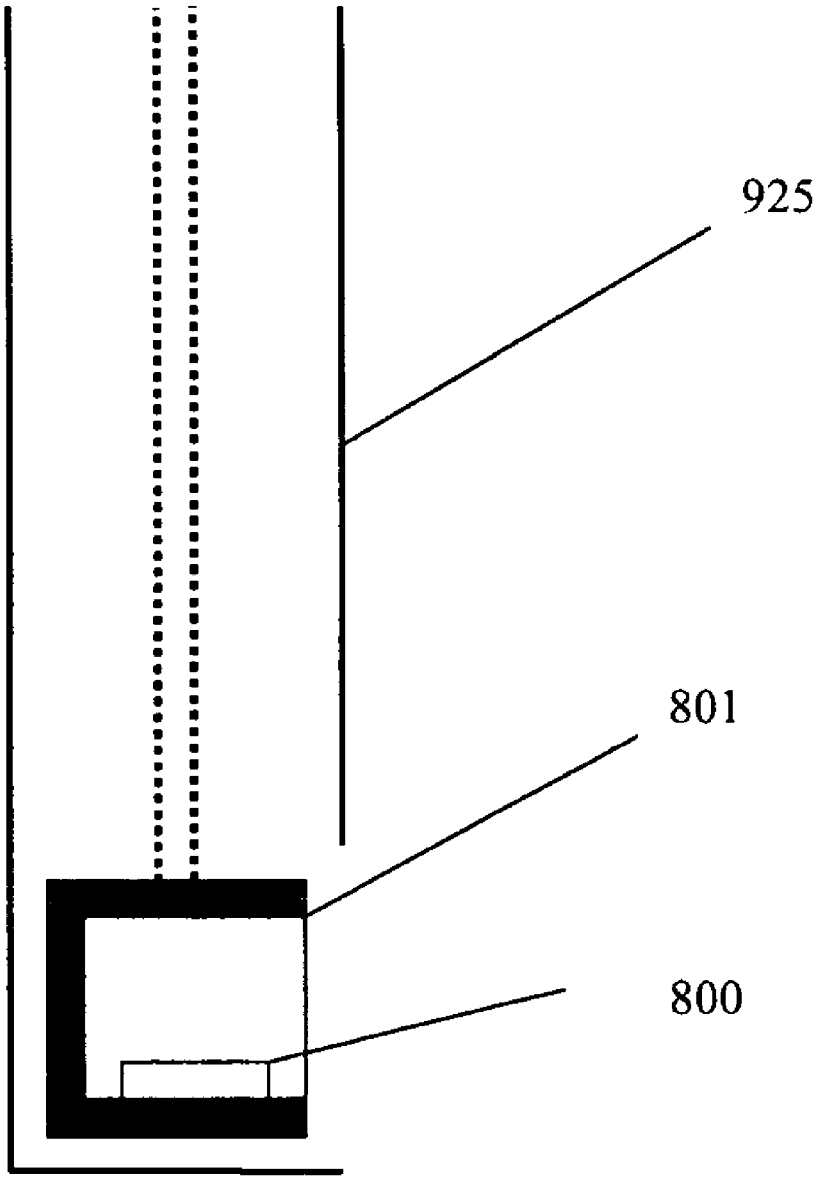
FIG. 17—is an illustration of a vertical lift system incorporated within a vertical spacer shaft, wherein the lift system transports at least one detection device.

FIG. 17 illustrates one preferred embodiment of a vertical shaft 925 incorporating a vertical inspection device 500 comprising: a lift system 801 and a detector (i.e. radiation detector) 800.

In an alternate arrangement, vertical spacers 925 include rough surfaces or grids (not shown) on their inner surfaces onto which the inspection apparatus 500 can grab as it moves along the side surfaces of the containers 130.

Tier Configured System

In a tier configured embodiment of the invention, the inspection apparatus is deployed along the side A 120 and/or along the side B 122 of the container 100. One embodiment of such an arrangement generally comprises: a plurality of stacked cargo containers arranged in tiers, each container having a top, a bottom a first side, a second side, a front end, and a back end; a plurality of spacers arranged in tiers; one or more mobile inspection device for inspecting the cargo containers, wherein the one or more inspection device are removably disposed within spacers, the inspection device configured to move through the spacer.

FIG. 6 shows a schematic diagram of a container 100 modified for such an arrangement. A vertical spacer 600 is positioned at the side A 120 of the container 100. The spacer can be made of materials such as steel, aluminum, or any other material appropriate for containers. The vertical spacer 600 has a first rectangular portion 610 that can be attached to the side 120 of the container 100. The first rectangular portion 610 has approximately the same height H and length Las the container 100. The vertical spacer 600 has a second rectangular portion 620 that is approximately the same size as the first portion 610. The twistlocks of the spacer can engage the castings on the side of the containers.

There are four horizontal corner posts 630 that join the first portion 610 to the second portion 620. In some arrangements there are fittings at one or both ends of the corner posts 630, which can be used either for attaching the vertical spacer 600 to the container 100, for attaching a crane to the spacer/container assembly for lifting the assembly, or both.

In one arrangement, the corner posts 630 have a width of approximately 2 feet. In another arrangement, the corner posts 630 have a width between about 6 inches and 3 feet. The width of the corner posts 630 can be determined by the space necessary for the inspection apparatus to move easily through the vertical spacer 600. The vertical spacer 600 does not have to be as strong as the horizontal spacer 300, as the vertical spacer 600 does not have to support the weight of other containers 100. In one arrangement, there are several horizontal supports 635 between the bottom portion 310 and the top portion 320 at about 5 ft intervals along the length of the spacer 600. Many combinations of spacing intervals and strength of vertical supports 635 are possible. Additional vertical members 640 can be used to add stability to the vertical spacer 600 and/or to provide tracks along which the inspection apparatus can move. In one arrangement, each set of two horizontal supports 635 and two vertical members 640 is replaced by a rigid grid. The inspection apparatus can grab at the grid to lift and lower itself during inspection.

As the inspection apparatus moves vertically rather than horizontally (as in the embodiment of FIG. 3) during inspection. In one arrangement, the vertical spacer 600 is added on to the width of a standard cargo container 100. In another arrangement, the cargo container has a smaller width than standard, and the combined container and vertical spacer width is the same as the width of a standard cargo container.

Figure 7:
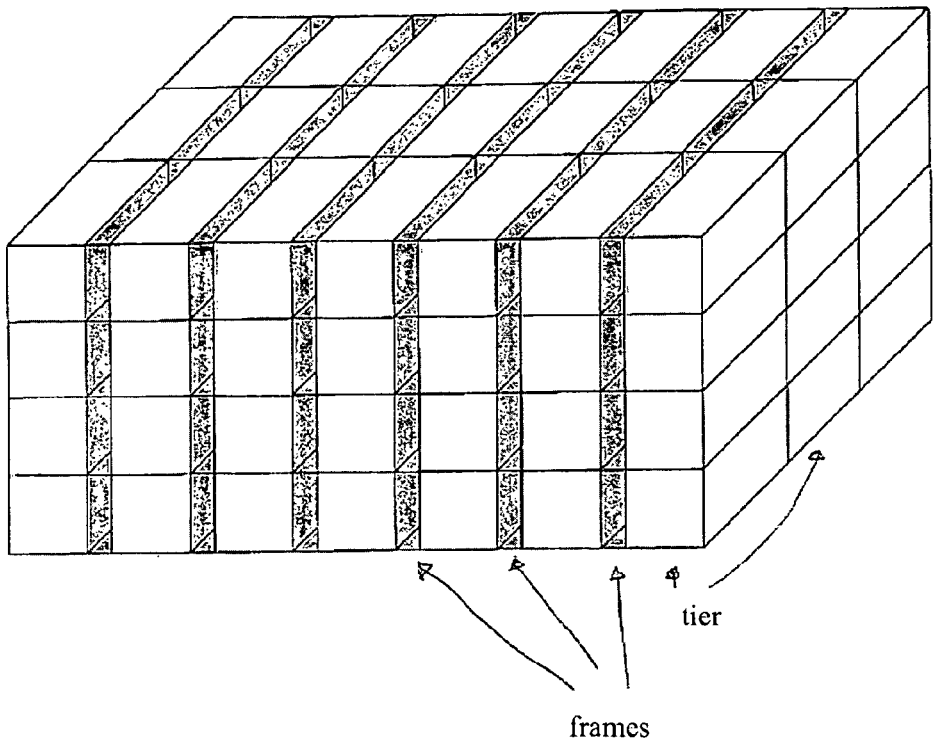
FIG. 7—is a schematic drawing of one embodiment of the invented system wherein the tires of containers are separated by tiers of spacers.

When the containers 100 are closely stacked, the spacers 600 are contiguous, so that the inspection apparatus can move through the continuous space provided by the spacers 600 along the sides 120 of all the containers in a tier. An additional layer of spacers 600 can be positioned at an unspacerd side of the entire stack to allow the inspection apparatus access to the last of the last tier of containers. FIG. 7 shows a portion of a container stack with spacer layers between container tiers. In one arrangement, the layer of spacers 600 between every row of containers has at least one inspection apparatus. In other arrangements, crew members can be trained to remove an inspection apparatus from one spacer layer after an inspection is finished and move the inspection apparatus to another spacer layer. Thus the number of inspection apparatus for performing a full inspection is reduced.

Containers with either horizontal or vertical spacers attached can be inspected not only in transit, but anytime they are stacked for a period of time long enough for the inspection apparatus to perform an inspection.

In such a system a vertical detection w/vertical transport is employed as discussed above. The vertical transport device (i.e. hoist etc.) vertically transports the detection device from one cargo container spacer to the next so that inspection can be carried out. As described above the detector and transport are wirelessly linked to a control and data device such as a pocket PC, PC or similar device.

Exemplary System Configurations

FIG. 15 illustrates one preferred embodiment of the invented system comprising: a series of stacked cargo containers, horizontal spacers 300 attached to each of the stacked containers which provide a defined space for one or more mobile inspection devices 501. The mobile inspection devices 501 comprising a radiation detector/identifier and a transport, the mobile inspection device capable of moving within defined space created by individual spacers as well as between the spacers of adjacently stacked containers to inspect cargo. The transport portion of the inspection device is wirelessly linked to a remote control device 700. Likewise the radiation detector/identifier portion of the inspection device is wirelessly linked to a control/receiving device (i.e. computer) 701.

FIG. 16 illustrates another preferred embodiment of the invented system comprising: a series of stacked cargo containers, vertical spacers 925 between the tiers stacked containers which provide a defined space for one or more mobile inspection devices 500. The mobile inspection devices 500 comprising a radiation detector/identifier and a transport, the mobile inspection device capable of moving between defined space created by individual spacers as well as between the spacers of adjacently stacked containers to inspect cargo. The mobile inspection device 501 (including the transport and radiation detector/identifier) are both wirelessly linked to a central control device 702 (i.e. computer and/or remote control).

Tier-Row Configuration

In another alternative embodiment, the system could employ both vertical spacers (or preferably a vertical spacer shaft) with a vertical transport (i.e. lift system) as well as horizontal spacers. This configuration would allow one to vertically transport a horizontal transport (i.e. robot) along each container tier and to each spacer row for further inspection, thus allowing both vertical and horizontal inspection.

Having described the basic concept of the invention, it will be apparent to those skilled in the art that the foregoing detailed disclosure is intended to be presented by way of example only, and is not limiting. Various alterations, improvements, and modifications are intended to be suggested and are within the scope and spirit of the present invention. Additionally, the recited order of the elements or sequences, or the use of numbers, letters or other designations therefore, is not intended to limit the claimed processes to any order except as may be specified in the claims. All ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like refer to ranges which can be subsequently broken down into sub-ranges as discussed above. Accordingly, the invention is limited only by the following claims and equivalents thereto.

All publications and patent documents cited in this application are incorporated by reference in their entirety for all purposes to the same extent as if each individual publication or patent document were so individually denoted.

I claim:

1. A system for inspecting stacked cargo containers, comprising:

a plurality of stacked cargo containers arranged in container rows, each container having a top, a bottom, a first side, a second side, a front end, and a back end;

a multitude of container spacers for creating a defined space between the container rows, wherein the container spacers are attached to the top or bottom of the stacked cargo containers forming a series of spacer rows;

one or more mobile inspection devices for inspecting the cargo containers, wherein the one or more mobile inspection devices are removeably disposed within one or more of the defined spaces created by the multitude of spacers, wherein the mobile inspection devices comprise: at least one radiation detecting detector or identifier attached to or incorporated into a mobile transport device, wherein, the mobile inspection device is capable of moving within the space created by the spacers to detect radiation within the cargo containers.

2. The system of claim 1, wherein the container spacers are attached to the top of the cargo containers.

3. The system of claim 1, wherein the container spacers are attached to the bottom of the cargo containers.

4. The system of claim 1, wherein the cargo containers are rectangular in shape and have four top corners and four bottom corners, wherein the 8 corners of the container incorporate standard corner castings, and wherein the spacers are rectangular in shape and have four top corners and four bottom corners, wherein the four top corners of the spacers incorporate standard corner castings, and wherein the four bottom corners of the spacers incorporate twistlocks which engage and lock into the corner castings of the cargo containers.

5. The system of claim 2, wherein the stacked containers and spacers have a specified stacking sequence from top to bottom of: ABAB . . . A, where A represents a spacer row and B represents a row of containers.

6. The system of claim 3, wherein the stacked containers and spacers have a specified stacking sequence from top to bottom of: ABAB . . . A, where A represents a row of containers and B represents a spacer row.

7. The system of claim 1, wherein the mobile inspection device is wirelessly linked to a computer or control system.

8. The system of claim 1, wherein the radiation detection device comprises an active or passive radiation detector.

9. The system of claim 1, wherein the mobile transport is a remote controlled robot.

10. A system for inspecting stacked cargo containers, comprising:

a plurality of stacked cargo containers arranged in tiers;

a plurality of vertical spacer shafts positioned between the cargo container tiers creating a defined space between the cargo container tiers; and one or more radiation detectors;

wherein one or more of the vertical spacer shafts incorporate a vertical transport, wherein the one or more radiation detectors are placed within the vertical transport and wherein the transport vertically transports the one or more radiation detectors along the height of the cargo container tiers to allow detection of radiation within the cargo containers.

11. The system of claim 10, wherein the transport is a lift system housed within the vertical spacer shaft.

12. The system of claim 10, wherein the transport is a means for vertically transporting the one or more radiation detectors along the height of the cargo container.

13. The system of claim 10, wherein the detector is wirelessly linked to a computer or control system.

14. The system of claim 10, wherein the radiation detector comprises an active or passive radiation detector.

15. A system for inspecting stacked cargo containers, comprising:

a plurality of cargo containers arranged in tiers;

a plurality of vertical spacer shafts positioned between the cargo container tiers creating a defined space between the cargo container tiers; and one or more inspection means;

wherein the vertical spacer shaft incorporates a vertical transport means for vertically transporting the one or more inspection means along the height of the cargo container tiers to detect radiation within the cargo containers.

16. The system of claim 15, wherein the transport means also transports the inspection means along the length of the container tier.

17. The system of claim 15, wherein the inspection means is wirelessly linked to a control system or computer.

18. A system for inspecting stacked cargo containers, comprising:

a plurality of stacked cargo containers arranged in container rows, each container having a top, a bottom, a first side, a second side, a front end, and a back end;

a multitude of container spacer means for creating a defined space between the container rows, wherein the spacer means are attached to the top or bottom of the stacked cargo containers forming a series of spacer rows;

one or more mobile inspection means for inspecting the cargo containers, wherein the one or more mobile inspection means is removeably disposed within one or more of the defined spaces created by the spacer means, wherein the mobile inspection means comprise: at least one radiation detecting means for detecting radiation attached to or incorporated into a mobile transport means for transporting the detection means through the spacer means, wherein, the mobile inspection means is capable of moving within the space created by the spacer and between adjacent spacers to detect radiation within the cargo containers.

* * * * *